US005930844A

United States Patent [19]

Scott, III

[11] Patent Number: 5,930,844

[45] Date of Patent: Aug. 3, 1999

[54] COMMODE VALVING ARRANGEMENT

[76] Inventor: Louis J. Scott, III, P.O. Box 1597, Winnie, Tex. 77665

[21] Appl. No.: 09/015,717

[22] Filed: Jan. 29, 1998

Related U.S. Application Data

[63] Continuation-in-part of application No. 08/720,955, Oct. 4, 1996, abandoned.

[51] Int. Cl.[6] ..... E03D 9/05

[52] U.S. Cl. ..... 4/213; 4/216; 4/349

[58] Field of Search ..... 4/213, 216–218, 4/347–352

[56] References Cited

U.S. PATENT DOCUMENTS

| | | | |
|---|---|---|---|
| 1,351,854 | 9/1920 | Kleme | 4/213 |
| 2,047,067 | 7/1936 | Harris | 4/216 |
| 2,449,134 | 9/1948 | Majauskas | 4/213 |
| 2,759,197 | 8/1956 | Majauskas | 4/213 |
| 3,192,539 | 7/1965 | Martz | 4/213 |
| 3,939,506 | 2/1976 | Pearson | 4/352 |
| 4,017,916 | 4/1977 | Pearson | 4/213 |
| 4,165,544 | 8/1979 | Barry | 4/213 |
| 4,166,298 | 9/1979 | Pearson | 4/213 |
| 4,864,664 | 9/1989 | Higgins | 4/213 |
| 5,029,346 | 7/1991 | Fernald, Sr. | 4/213 |
| 5,321,856 | 6/1994 | Gastesi | 4/348 |
| 5,369,810 | 12/1994 | Warren | 4/213 |

*Primary Examiner*—Charles R. Eloshway
*Attorney, Agent, or Firm*—Garvey, Smith, Nehrbass & Doody, L.L.C.

[57] ABSTRACT

A ventilation arrangement for a commode that is refilled after flushing with a water supply valving includes a tank with the water containing portion, a drain pipe for communicating between the tank and a bowl and an air transmission conduit that includes a blower and a blower ventilation duct that extends from the drain pipe to the blower for pulling a suction on openings within the base of the commode. An air flow control arrangement includes a housing that provides resistance to water flow into the air ventilation duct during a flush even while the blower is ventilating. During a flush, air flow seeks a path of least resistance through the housing. After flushing occurs, air flow seeks a path of least resistance through the closed tank drain line to the openings in the bowl.

14 Claims, 2 Drawing Sheets

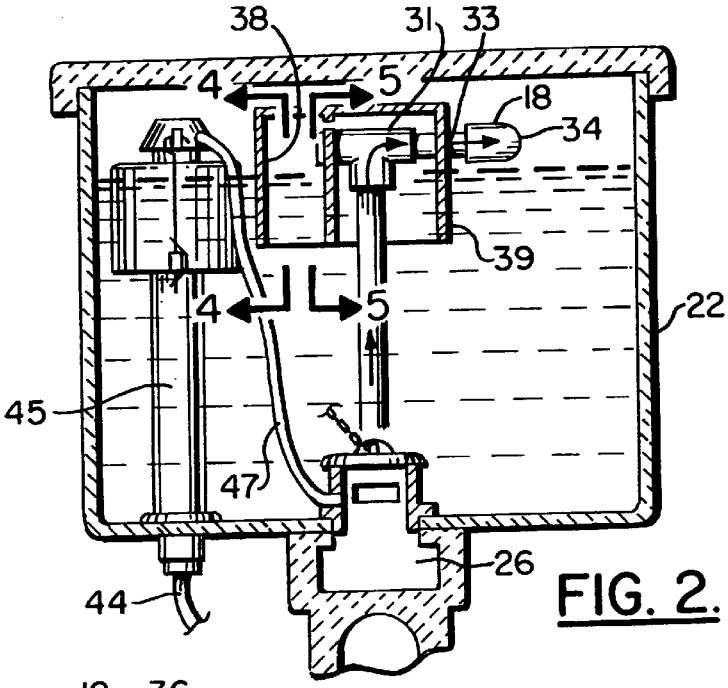
FIG. 2.
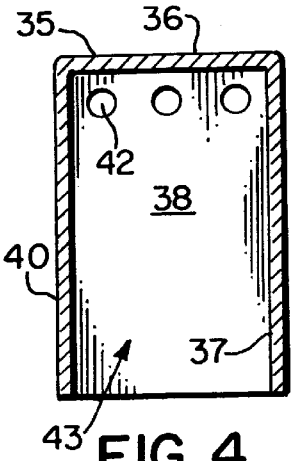
FIG. 4.
FIG. 5.
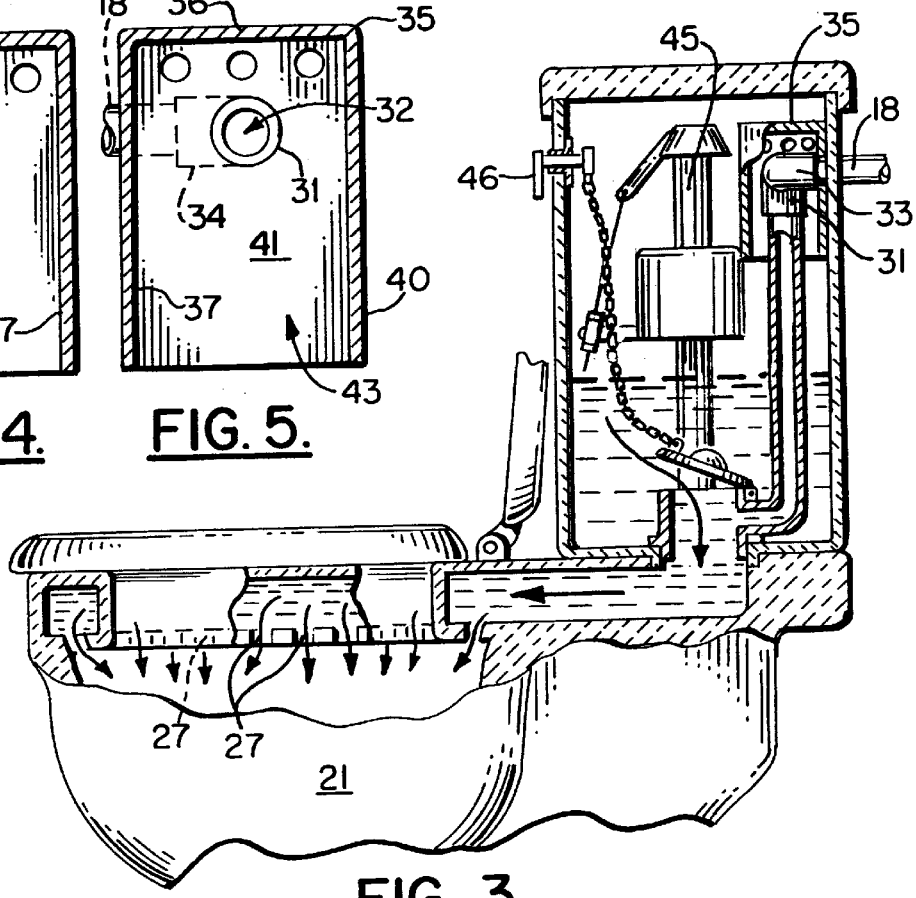
FIG. 3.

COMMODE VALVING ARRANGEMENT

CROSS-REFERENCE TO RELATED APPLICATIONS

This is a continuation in part of U.S. patent application Ser. No. 08/720,955, filed Oct. 4, 1996, now abandoned, which is incorporated herein by reference.

BACKGROUND OF THE INVENTION

1. Field of the Invention

The present invention relates to water closets, commodes and the like and more particularly to an improved valving and ventilation arrangement wherein a common flow line is used to supply fresh water to the commode bowl and to ventilate the bowl with a provided vacuum source, and wherein a flow controller prevents water flow into the vacuum unit during flushing.

2. General Background of the Invention

The Pearson U.S. Pat. No. 4,017,916 discloses a ventilator for toilets which includes an air duct to receive and remove the odorous air flow, a control for initiating and terminating the odorous air flow, and an electrical transducer responsive to the motion of the toilet flushing mechanism so as to terminate the air flow at the moment the toilet is flush.

BRIEF SUMMARY OF THE INVENTION

The present invention provides an improved valving and ventilation for commodes wherein a ventilating conduit ventilates the commode until flushing occurs at which time a valving arrangement closes the ventilation conduit using a float valve arrangement and opens the conduit again after flushing is completed.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 2 is a schematic elevation, frontal fragmentary view of the preferred embodiment of the apparatus of the present invention taken along lines 2—2 of FIG. 1;

FIG. 3 is a schematic side, elevational view of the preferred embodiment of the apparatus of the present invention;

FIG. 4 is a sectional view taken along lines 4—4 of FIG. 2; and

FIG. 5 is a sectional view taken along lines 5—5 of FIG. 2.

DETAILED DESCRIPTION OF THE INVENTION

Figure 1:
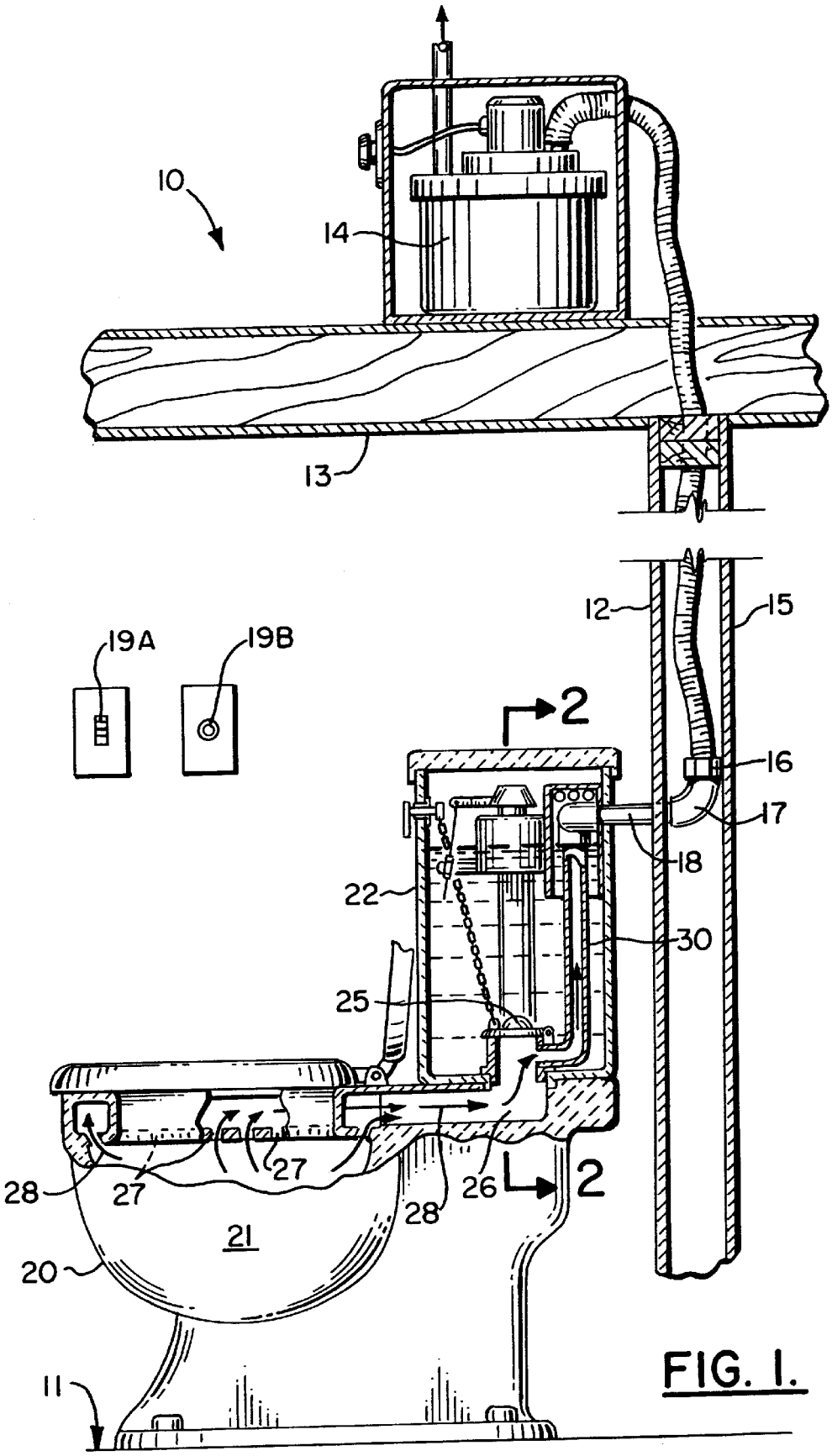
FIG. 1 is an elevational view of the preferred embodiment of the apparatus of the present invention in a first, field operating position.

FIGS. 1–3 show the preferred embodiment of the apparatus of the present invention designated generally by the numeral 10 in FIG. 1. Ventilation apparatus 10 is used in combination with a standard commode that is affixed to floor 11. Wall 12 carries air suction line 15. Vacuum or blower 14 is positioned out of view above ceiling 13. Vacuum or blower 14 is used to draw a vacuum in line 15 for ventilating the bowl 21 of commode 20 when water 23 in tank 22 is not being used to flush commode 20.

Line 15 is connected at union 16 to elbow 17 and pipe section 18. Pipe section 18 connects to elbow 34 which is connected to tee fitting 31 with pipe section 33. The tee fitting 31 is open at outlet 31 to communicate with the interior of housing 35.

Operation of the apparatus of the present invention is initiated when a user activates switch 19A to the "on" position and light indicator 19B illuminates indicating the users that the system is operational. When the switch 19A is placed in the "on" position, the blower/vacuum 14 begins to pull a vacuum in line 15 that communicates via elbow 17 with pipe section 18 and tee fitting 31. This vacuum communicates with tee fitting 31 as shown in FIG. 2 so that air flows from bowl 21 through openings 27 and into drain line 26 as shown by the arrows 28 in FIG. 1. In the position of FIG. 1, drain valve 25 is closed so that air can flow from bowl 21 through openings 27 to drain line 26 and the bypass valve. 25 to enter riser 30. The riser 30 extends upwardly to form a connection with tee fitting 31 as shown in FIGS. 1–3. The tee fitting 31 has an outlet 32 that communicates with the interior of housing 35. Tee fitting 31 communicates with elbow 17 by means of pipe section 33. Riser 30 includes a lower elbow 29 that forms a joint and interface with drain line 26 as shown in FIG. 3.

Housing 35 is shown more particularly in FIGS. 4–5. The housing 35 includes a top wall 36, a rear wall 37, side walls 38 and 39, and a front wall 40. A baffle 41 divides the housing 35 into two sections 35A and 35B.

The side wall 38 has a plurality of openings 42 as shown in FIG. 4. These openings are sized and shaped to provide flow resistance so that the air follows the path of least resistance when the tank is full with a water supply 23 as shown in FIG. 2 with maximum water surface 24. In that position, air flows through riser 30 and also enters tee fitting 31 at outlet 32. However, the outlet 32 can only obtain as much air flow as is allowed by the openings 42 as the lower end of housing 35 is closed due to the high water level shown by water surface 24 in FIG. 2. While some air will enter housing 35 interior via openings 42, the majority of the air entering tee fitting 31 will be from the bowl 21 travelling upwardly as shown in FIG. 2 through riser 30.

When the control valve 25 is opened as shown in FIG. 3, the water level 24 drops to that shown in FIG. 3 filling drain line 26 and travelling via openings 27 to bowl 21 as shown in FIG. 3. This opens the bottom of housing 35 because it has an open bottom 43 portion as shown in FIGS. 2–5. When the water level 24 has dropped to the level shown in FIG. 3, air can flow into outlet 32 via the open bottom 43 thus defining a path of least resistance. In this case, air flows into opening 32, tee fitting 31 and eventually to suction line 15 because that is a path of least resistance. Water will not be suctioned into the suction line 15 because the emptying of tank 22 fills the drain line 26, thus providing too much resistance for water flowing upwardly in drain line 30.

The apparatus 10 of the present invention can be provided with a water supply line 44, a water in flow mechanism 45 and handle 46, all of which are commercially available. Flow line 47 carries water from mechanism 45 to drain line 26 and also begins to fill tank 22 after a flush.

The following table lists the parts numbers and parts descriptions as used herein and in the drawings attached hereto.

PARTS LIST

| Part Number | Description |
|---|---|
| 10 | commode ventilation apparatus |
| 11 | floor |
| 12 | wall |
| 13 | ceiling |
| 14 | blower/vacuum |
| 15 | suction line |
| 16 | union |
| 17 | elbow |
| 18 | pipe section |
| 19A | switch |
| 19B | light indicator |
| 20 | commode |
| 21 | bowl |
| 22 | tank |
| 23 | water supply |
| 24 | water surface |
| 25 | drain valve |
| 26 | water drain flow line |
| 27 | opening |
| 28 | arrow |
| 29 | elbow |
| 30 | riser |
| 31 | tee fitting |
| 32 | outlet |
| 33 | pipe section |
| 34 | elbow |
| 35 | housing |
| 36 | top wall |
| 37 | rear wall |
| 38 | side wall |
| 39 | side wall |
| 40 | front wall |
| 41 | baffle |
| 42 | opening |
| 43 | open bottom |
| 44 | water supply line |
| 45 | water inflow mechanism |
| 46 | handle |
| 47 | flow line |

The foregoing embodiments are presented by way of example only; the scope of the present invention is to be limited only by the following claims.

I claim:

1. A valving and ventilation apparatus for a commode that is refilled after flushing with a water supply valve, comprising:

a) a commode bowl and tank, the tank defined by tank sidewalls surrounding a water containing portion wherein a waterline moves between "full" and "empty" positions, the bowl having a plurality of water discharge openings for adding water to the bowl when the commode is flushed;

b) a water drain pipe for communicating between the tank and the water discharge openings of the bowl;

c) a water control valve for controlling water flow from the tank to the bowl via the drain pipe;

d) air transmission means that includes a blower and a blower ventilation duct that extends from the water drain pipe downstream of the water control valve to the blower for pulling a suction on the water drain pipe and the openings;

e) the ventilation duct including a lower end portion that includes a pipe that extends from the drain pipe downstream of the water control valve to an upper end portion of the tank, the pipe having an upper end with a branch fitting thereon;

f) an air flow control device housed within the tank and surrounding the branch fitting for controlling air flow, and including an air intake housing contained within the tank and spaced inwardly of the tank walls during use, the housing comprising a plurality of walls including a top wall, side walls with an open bottom portion, and a pair of chambers separated by a baffle wall wherein said branch fitting has one air conveying portion that extends through one of said chambers to the blower on one side of the baffle and another air conveying portion that extends to the opposite side of the baffle for enabling air to flow from the other of said chambers to the blower;

g) wherein the air transmission means provides first and second air intakes including the open bottom of the housing and at least one opening in one of the housing side walls so that insufficient suction is available to pull water to the blower during flushing thus enabling the suction to operate even during flushing.

2. The valving and ventilation apparatus of claim 1 wherein the housing is partially submerged by water in the tank when ventilation occurs.

3. The valving and ventilation apparatus of claim 1 wherein the housing has two halves separated by a baffle, and one-half has a wall with at least one opening.

4. The valving and ventilation apparatus of claim 1 wherein the ventilation duct has a tee positioned inside the housing.

5. The valving and ventilation apparatus of claim 4 wherein one of the housing chambers carries the tee.

6. The valving and ventilation apparatus of claim 1 further comprising a flow mechanism inside the tank and spaced from the air intake housing and a flow line that carries water from the flow mechanism to the drain pipe below the water control valve.

7. The valving and ventilation apparatus of claim 1 wherein, when the water line drops below the level of the bottom of the housing open during flushing, air can then enter the air intake housing via the open bottom.

8. A valving and ventilation apparatus for a commode that is refilled after flushing with a water supply valve, comprising:

a) a commode bowl and tank, the tank having a water containing portion wherein a waterline moves between "full" and "empty" positions, the bowl having a plurality of water discharge openings for adding water to the bowl when the commode is flushed;

b) a water drain pipe for communicating between the tank and the openings of the bowl;

c) a valve for opening or closing the drain pipe;

d) an air transmission device that includes a blower, a blower ventilation duct that extends from the drain pipe downstream of the valve to the blower for pulling a suction on the openings and an air flow control that prevents water from reaching the blower during flushing;

e) the air flow control including a separate air flow control housing positioned within the tank and spaced inwardly therefrom, said housing being partially submerged during use and including first and second chambers separated by a baffle wall;

f) the ventilation duct including a pipe that has a lower end forming a connection to the drain pipe down stream of the valve and an upper end connected to the air flow control housing;

g) the pipe upper end extending into the air flow control housing interior and including a branch flow line portion that extends to opposing sides of the baffle; and h) wherein the branch flow line has one air conveying portion that extends through the first chamber to the blower on one side of the baffle and another air conveying portion that extends to the onposite side of the baffle for enabling air to flow from the second chamber to the blower, the second chamber having air intake openings above the "full" waterline.

9. The valving and ventilation apparatus of claim 8 wherein the housing is positioned partially below the full water line when ventilation occurs.

10. The valving and ventilation apparatus of claim 8 wherein the housing has a tee therein and the ventilation duct extends to the tee.

11. The valving and ventilation apparatus of claim 10 wherein the tee has two flow line portions, one of which extends externally of the housing.

12. The valving and ventilation apparatus of claim 11 further comprising an opening through the housing.

13. The valving and ventilation apparatus of claim 12 wherein the housing has a plurality of side walls and an open bottom that enables water to rise up into the interior of the housing.

14. The valving and ventilation apparatus of claim 8 further comprising a flow mechanism inside the tank and spaced from the air flow control housing and a flow line that carries water from the flow mechanism to the drain pipe below the valve.

* * * * *